US005794813A

United States Patent [19]

Lin

[11] Patent Number: 5,794,813

[45] Date of Patent: Aug. 18, 1998

[54] STRUCTURE OF STORING TANK

[76] Inventor: Chien-Hung Lin, 3F., No. 145-1, Sec. 5, Nan-Ching E. Road, Taipei, Taiwan

[21] Appl. No.: 686,024

[22] Filed: Jul. 25, 1996

[51] Int. Cl.[6] ..... B65D 7/00

[52] U.S. Cl. ..... 220/565; 220/578

[58] Field of Search ..... 220/578, 565, 220/1.5, 4.12, 4.16

[56] References Cited

U.S. PATENT DOCUMENTS

| | | | |
|---|---|---|---|
| 1,213,041 | 1/1917 | Veckruise | 220/565 X |
| 1,232,929 | 7/1917 | Keller | 220/565 |
| 1,958,487 | 5/1934 | Moran | 220/565 X |
| 3,273,741 | 9/1966 | Faunce | 220/578 X |
| 5,570,805 | 11/1996 | Harding | 220/565 |

*Primary Examiner*—Steven M. Pollard
*Attorney, Agent, or Firm*—Bacon & Thomas

[57] ABSTRACT

A storing tank, in which the storage space can be multiplied to a suitable extent, and the area occupied by it can be reduced. It has a lower tank member, an access gate, a pushing mechanism, an upper tank member and an outlet. Material put in the access gate falls onto the pushing mechanism to be pushed upwardly into the lower tank member. When the latter is full, the upper tank member is moved upwardly by the increasing material to increase the receiving space until the upper tank member is moved to the highest position. When the outlet is opened, the material can automatically fall down along a bevel guiding surface in the lower tank member and out of the outlet.

7 Claims, 4 Drawing Sheets

STRUCTURE OF STORING TANK

BACKGROUND OF THE INVENTION

1. Field of the Invention

The present invention relates to a storing tank, and especially to one in which its receiving space can be expanded. The storing tank is comprised of a lower and an upper tank member, such that when a user places material in an access gate, the material can be pushed upwardly by a pushing mechanism into the lower tank member and when the lower tank member is full, the upper tank member can be automatically moved upwardly to enlarge the receiving space of the storing tank.

2. Description of the Prior Art

A storing tank is used specifically to offer receiving space for lodging various material, the extent of use being very wide. For example, it can be used for storing waste, garbage, slurry, or for food such as rice, beans, or for various bulk cargo such as cotton etc.. The structure thereof will be somewhat different depending on the material received therein, e.g., when storing garbage, dirt and water-proof should be put in consideration; and when storing rice, humidity-proof is required, and so on. Nevertheless, their structures are mostly the same, the basic structure of the conventional storing tanks is now to be stated in the following description.

Referring to FIG. 1, the conventional storing tanks comprise a horizontally placed tank body 1 which is mounted horizontally on the ground and is provided with an access gate 2 and an outlet 3. A pushing mechanism 4 is provided therein such that, when a user puts material in the tank body 1, and when the material accumulates to quite an amount under the access gate 2, the pushing mechanism 4 pushes the material toward the outlet 3. Therefore, by means of the pushing mechanism 4, the material can be poured out of the outlet 3.

The above stated conventional structure has the following disadvantage in structural design which results in serious inefficiency of the use of available space:

1. The tank body 1 is mounted horizontally on the ground and occupies quite a large area. To unload a truck must stop in front of the outlet 3. Therefore, the area in front of the outlet 3 must be quite large to accommodate the truck.

2. The tank body 1 has to be provided with, beside the space for receiving the material, the pushing mechanism 4, which occupies about one third of the total space in the tank body 1. The receiving capacity of the tank body 1 therefore is reduced.

3. The height of the access gate 2 is limited in use, i.e., it cannot be too high, otherwise, the material will be hard to be thrown in. The height of the tank body 1 therefore is limited too, limiting its capacity of the tank body 1.

Providing for the pushing mechanism 4 and room for the truck are inevitable in the conventional prior art. Hence it is required to increase storage space in the upward direction so that the aforesaid limitation can then be overcome, i.e., in a limited room occupied by a storing tank, storing space can be largely increased.

SUMMARY OF THE INVENTION

In view of this, the inventor of the present invention provides a storing tank for increasing storing space after thorough study for developing various measures in solving the limitation.

Particularly, the storing tank of the present invention comprises a lower tank member, an access gate, a pushing mechanism, an upper tank member and an outlet.

The lower tank member is in a shape of a barrel and is placed on the ground, a base being provided on the bottom. The top of the base is formed with a bevel guiding surface above which a receiving space is formed. A stop flange is provided on the top inner periphery of the lower tank member.

The access gate is provided at a suitable level on the external wall of the lower tank member. Material can be placed into the lower tank member from outside through the access gate.

The pushing mechanism is provided on the inner wall of the lower tank member. Material placed through the access gate can exactly fall onto the pushing mechanism which is operated by a screw conveyor driven by a motor.

The upper tank member is in a shape of a cap telescopically fitted inside the top edge of the lower tank member to be movable relative to the latter. When it moves up to the highest level, it can be stopped by the stop flange.

The outlet is provided on the wall of the lower tank member. The lower edge thereof is flush with the lower end of the bevel guiding surface in the lower tank member and is provided with an openable lid.

By the above stated structure, when a user puts material in the access gate, the material can be pushed upwardly by the pushing mechanism onto the bevel guiding surface on the base in the lower tank member and can slide or roll down along the bevel guiding surface to the lower end of the latter and can be stopped by the lid in its closed position. When the lower tank member is full, the material will be pushed upwardly by the pushing mechanism, the upper tank member thereby is moved upwardly to increase the receiving space until it is moved to the highest position where it is stopped by the stop flange of the lower tank member. In this position, the whole storing tank is full. The material is taken out by opening the lid to open the outlet, and the material can automatically fall down along the bevel guiding surface.

The primary object of the present invention is to increase receiving capacity of the whole storing tank and to reduce the area occupied by the storing tank. The measures for achieving such an object is using the above stated upper tank member telescopically fitted inside the top edge of the lower tank member such that, when the lower tank member is full, the upper tank member can be moved upwardly automatically to increase receiving space. The receiving capacity of the storing tank is twice of that of a normal storing tank. I.e., for a certain receiving capacity, a conventional structure may need two storing tanks, while the present invention needs only one. In this view, area occupied by the present invention can be much reduced. In actual practice, one or more middle tank members can be telescopically inserted between the upper and the lower tank members. Hence, when all the member tanks are fully extended, receiving capacity of the whole storing tank will be more than twice of that of a normal storing tank. By all means, the measures of adding middle tank members to increase receiving space shall include consideration about pushing force of the pushing mechanism. A design for such storing tank must be within the capability of the pushing mechanism.

The present invention will be apparent in its practical structure after reading the detailed description of the preferred embodiments thereof in reference to the accompanying drawings.

DETAILED DESCRIPTION OF THE PREFERRED EMBODIMENT

Figure 1:
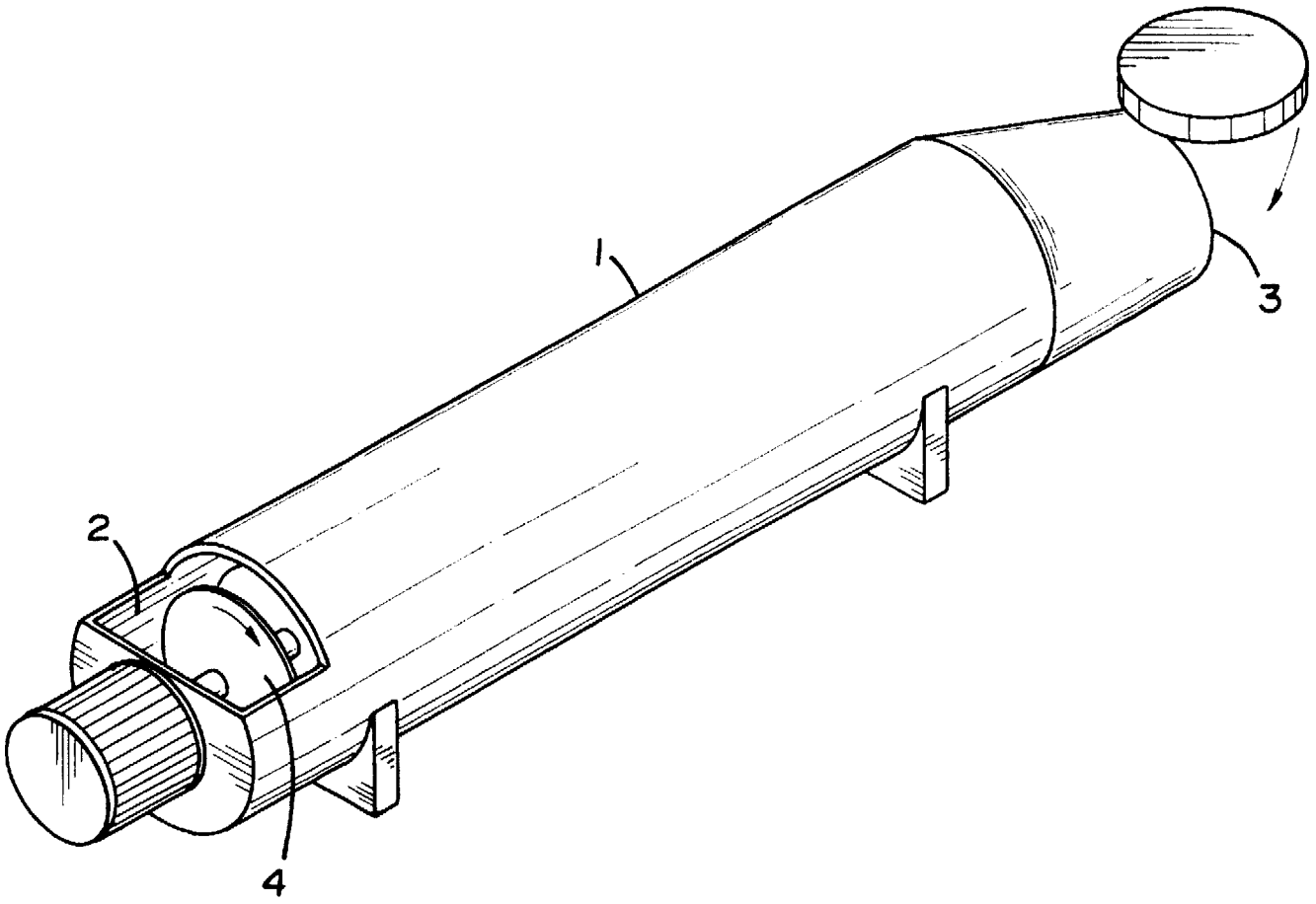
FIG. 1 (PRIOR ART)
FIG. 1 is a perspective view of a conventional storing tank.
Figure 2:
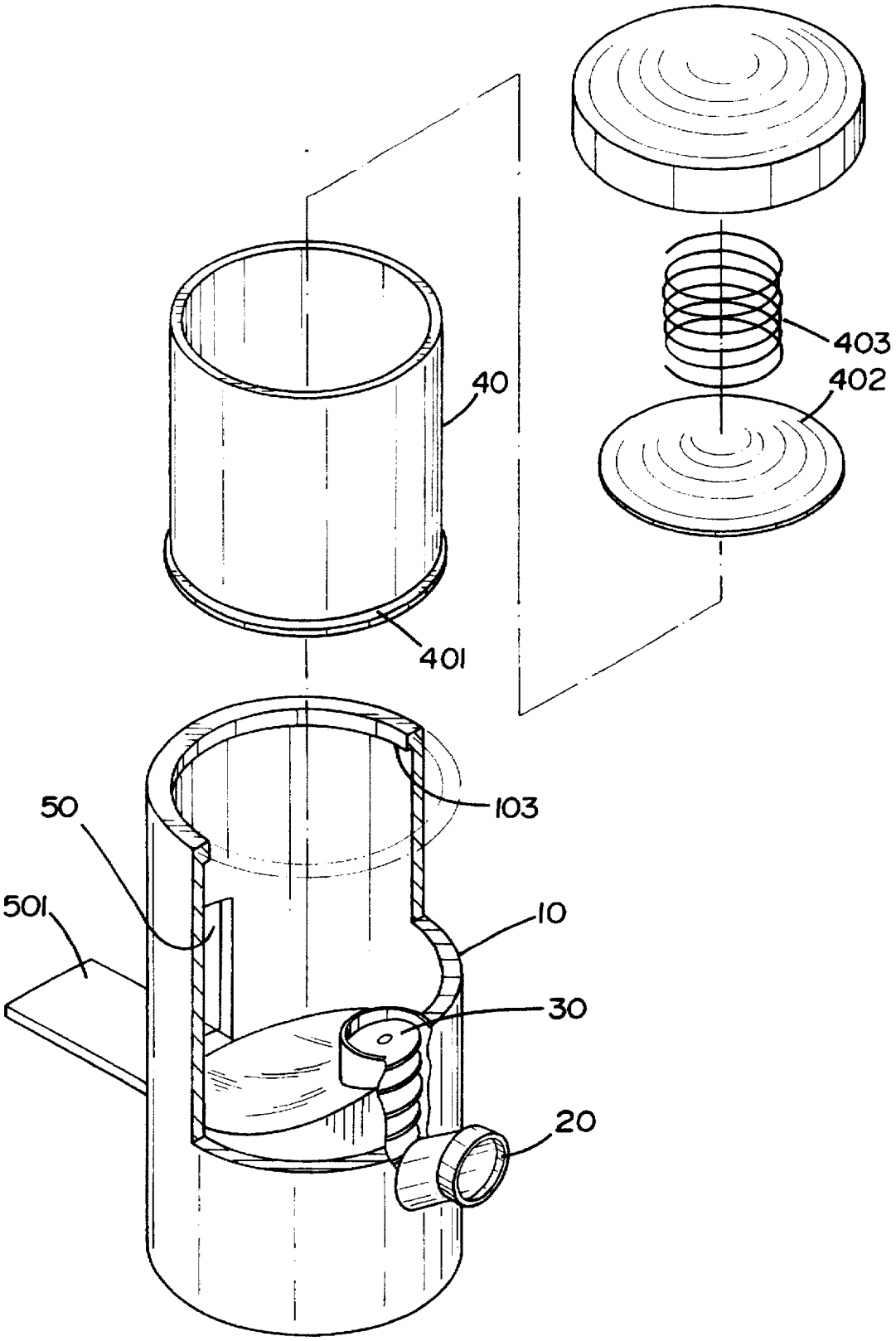
FIG. 2 is an exploded perspective view of the present invention.
Figure 3:
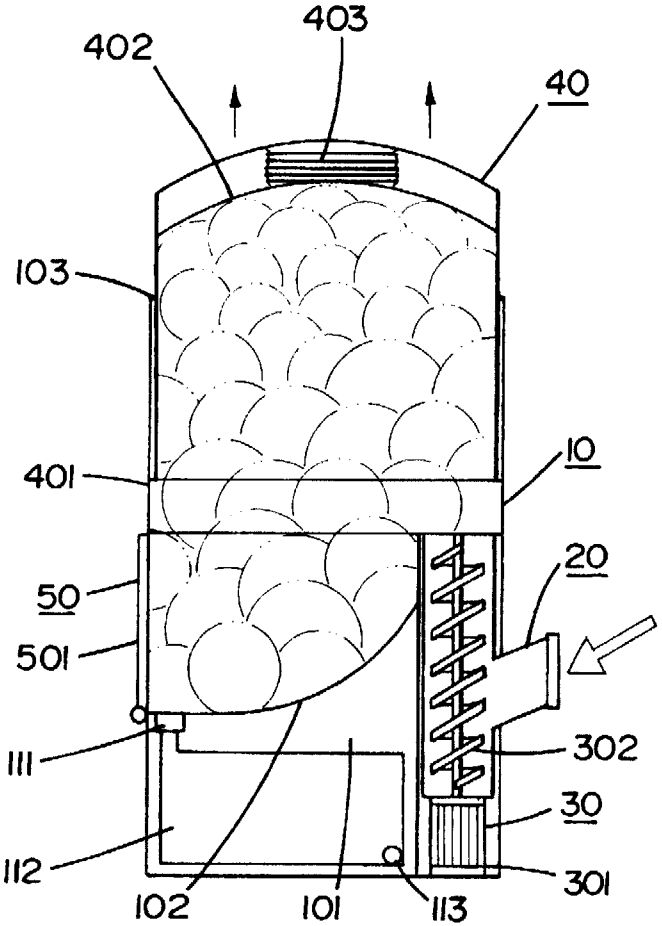
FIG. 3 is a schematic view of the present invention for receiving material.

Referring to FIGS. 2 and 3, the storing tank of the present invention is comprised of a lower tank member 10, an access gate 20, a pushing mechanism 30, an upper tank member 40 and an outlet 50.

The lower tank member 10 is in a shape of a barrel and is placed on the ground. A base 101 is provided on the bottom thereof, the top of the base 101 is formed as a bevel guiding surface 102 above which a receiving space is formed. A stop flange 103 is provided on the top inner periphery of the lower tank member 10.

The access gate 20 is provided on a pipe at a suitable level on the external wall of the lower tank member 10. Material can be placed into the lower tank member 10 from outside through the access gate 20.

The pushing mechanism 30 is provided on the inner wall of the lower tank member 10. Material placed through the access gate 20 can exactly fall onto the pushing mechanism 30 which is operated by a screw conveyor 302 driven by a motor 301. The material can be pushed upwardly by the pushing mechanism 30 onto the bevel guiding surface 102 of the lower tank member 10.

The upper tank member 40 is in a shape of a cap telescopically fitted inside the top edge of the lower tank member 10 to be movable upwardly and downwardly relative to the latter, so that the whole storing tank is extendible. A limiting edge 401 is provided thereon to be abuttingly stopped by the stop flange 103 of the lower tank member 10 when the upper tank member 40 is moved up to the highest level.

The outlet 50 is provided on the wall of the lower tank member 10, the lower edge thereof is flush with the lower end of the bevel guiding surface 102 in the lower tank member 10 and is provided with an openable lid 501 which is used to close the lower tank member 10.

By the above stated structure, when a user puts material in the access gate 20, the material can fall onto the pushing mechanism 30 and can be pushed upwardly by the pushing mechanism 30 onto the bevel guiding surface 102 on the base 101 in the lower tank member 10 and can slide or roll down along the bevel guiding surface 102 to the lower end of the latter, which is flush with the lower edge of the outlet 50. At this time, the openable lid 501 on the outlet 50 is in its closed state. Therefore, the material continuously put in the access gate 20 will be piled upwards gradually. When the lower tank member 10 is full, the material is pushed upwardly by the pushing mechanism 30, and the upper tank member 40 will also be moved upwardly to increase receiving space until the upper tank member 40 is moved to the highest position where the limiting edge 401 thereof is stopped by the stop flange 103 of the lower tank member 10. In this position, the whole storing tank is full. The material can be taken out by opening the lid 501 to open the outlet 50, and the material can automatically fall down along the bevel guiding surface 102 and out of the outlet 50. When the material is put out, the upper tank member 40 thereby will be moved downwardly into its original state.

In practice of the present invention for storing waste such as garbage, as shown in FIG. 3, in order to prevent sewage from leaking out, a water collecting groove 111, a sewage trough 112 and a discharge hole 113 can be provided in the base 101, so that sewage can flow through the water collecting groove 111 into the sewage trough 112, and be discharged from the discharge hole 113 to a sewer.

As shown in FIG. 2, 3, a pusher plate 402 can be provided on the top of the upper tank member 40, and an elastic element 403 provided between the pusher plate 402 and the upper tank member 40. When the material is piled to a full state, it will compress the elastic element 403, and if the lid 501 is opened, the material will be pressed down by elastic restoring force of the elastic element 403. The material is thereby discharged very quickly out of the outlet 50.

Figure 4:
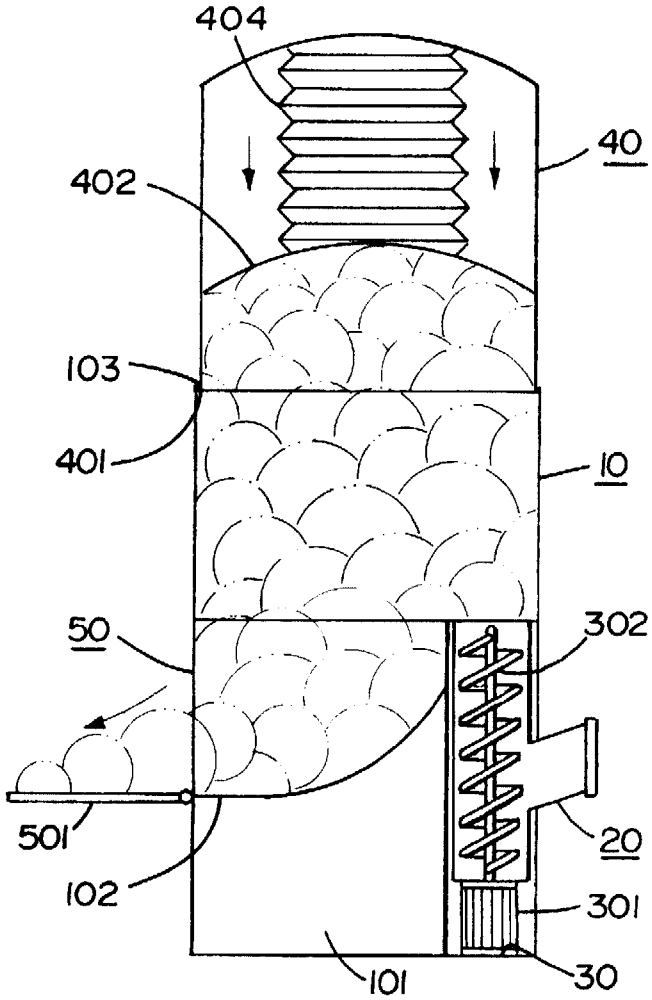
FIG. 4 is a schematic view of the present invention showing discharge of the stored material.

FIG. 4 shows that the upper tank member 40 can also be provided on the top thereof with a stretchable bellows 404, so that when the material is piled to a full state, it will also compress the stretchable bellows 404 to render the air therein to be compressed. When the material is put out, this can be an aid for pushing down the material.

Figure 5:
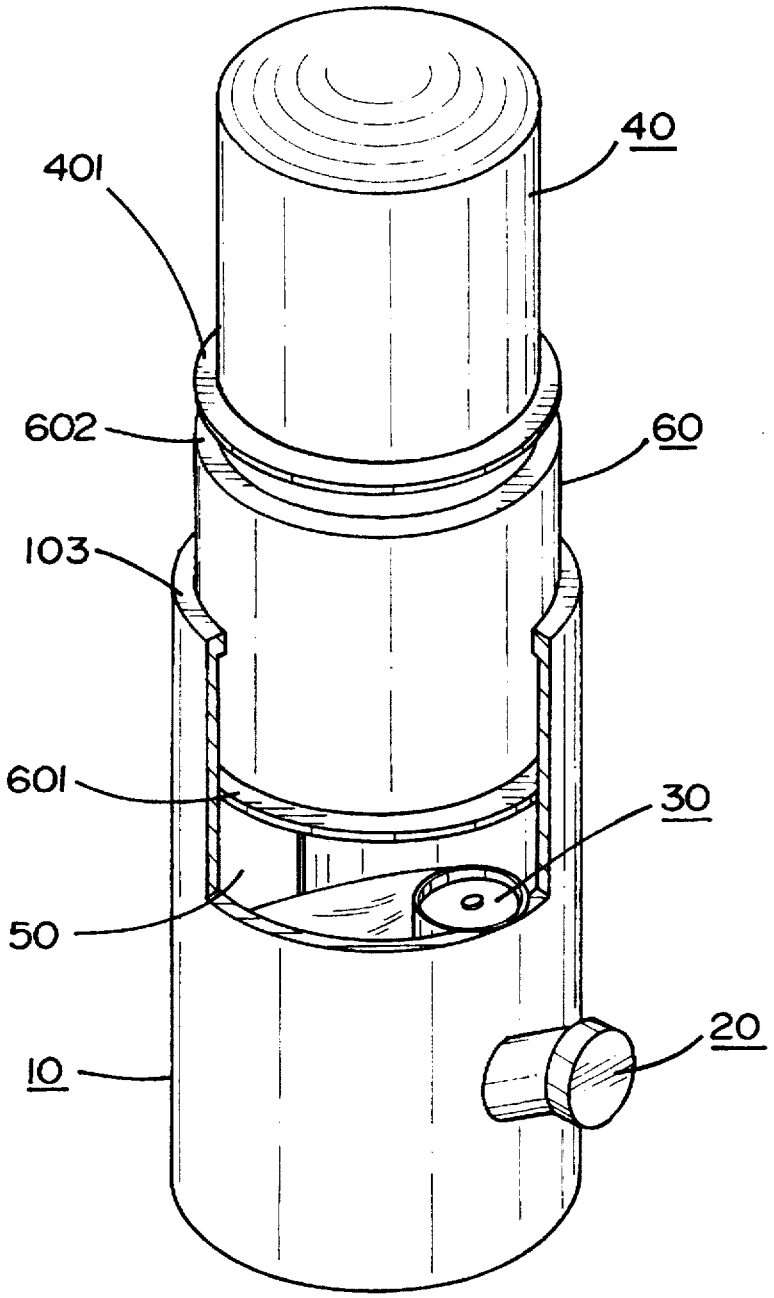
FIG. 5 is a perspective view of an embodiment of the present invention having increased receiving space.

FIG. 5 shows that one or more middle tank members 60 can be telescopically inserted between the upper and the lower tank members 40, 10. In this case, the top edge 602 of each middle tank member 60 is formed in a similar way to the stop flange 103 of the lower tank member 10 in the foregoing embodiments, while the bottom edge of each middle tank member 60 is provided with a limiting edge 601 similar to the limiting edge 401 of the upper tank member 40. All the middle tank members 60 can thereby can be telescopically mounted between the upper and the lower tank members 40, 10, and the receiving space in the storing tank can be increased thereby.

Having now particularly described and ascertained the nature of our said invention and in what manner the same is to be performed, we declare that what we claim is:

1. A storing tank, comprising:

a lower tank member having a base on a bottom thereof, a top of said base forming a bevel guiding surface above which is a receiving space, a stop flange provided on a top inner periphery of said lower tank member;

an access gate provided on an external wall of said lower tank member, whereby material can be placed into said lower tank member from outside of the lower tank member;

a pushing mechanism provided within said lower tank member adjacent to the access gate whereby material placed through said access gate falls onto said pushing mechanism which pushes the material upwardly onto said bevel guiding surface of said lower tank member;

an upper tank member telescopically connected to said lower tank member and movable relative to said lower tank member, a limiting edge on said upper tank member located so as to be abuttingly stopped by said stop flange of said lower tank when said upper tank member is moved up to an extreme position;

an outlet provided on said lower tank member, a lower edge of said outlet being flush with a lower end of said bevel guiding surface; and an openable lid on said lower tank member for opening and closing said outlet.

2. The storing tank as claimed in claim 1, wherein said base further comprises:

a water collecting groove, and a sewage trough having a discharge hole, the sewage trough communicating with the water collecting groove.

3. The storing tank as claimed in claim 1, wherein;

said pushing mechanism comprises a motor and a screw conveyor driven by said motor.

4. The storing tank as claimed in claim 1, wherein said upper tank member comprises a pusher plate and an elastic element provided on a top of said upper tank member.

5. The storing tank as claimed in claim 1, wherein said upper tank member comprises a pusher plate and a bellows provided on a top of said upper tank member.

6. The storing tank as claimed in claim 1, further comprising at least one middle tank member telescopically inserted between said upper and lower tank members.

7. The storing tank as claimed in claim 6, wherein:

a bottom edge of each of said at least one middle tank members has a limiting edge adjacent to a bottom thereof and a stop flange extending inwardly from a top edge thereof.

* * * * *